US005709612A

United States Patent [19]

Salado

[11] Patent Number: 5,709,612

[45] Date of Patent: Jan. 20, 1998

[54] GOLF PUTTING DEVICE

[76] Inventor: Raymond Anthony Salado, 1703 W. Ave. K-12, Lancaster, Calif. 93534

[21] Appl. No.: 748,098

[22] Filed: Nov. 13, 1996

[51] Int. Cl.[6] ..... A63B 69/36

[52] U.S. Cl. ..... 473/240; 473/340; 473/253

[58] Field of Search ..... 473/240, 340, 473/253

[56] References Cited

U.S. PATENT DOCUMENTS

| | | | |
|---|---|---|---|
| D. 245,438 | 8/1977 | Thiel | D34/5 |
| 2,463,291 | 3/1949 | Mazzioti | 473/240 |
| 3,700,244 | 10/1972 | Liotta | 273/183 D |
| 3,727,919 | 4/1973 | Scott | 273/186 A |
| 4,953,866 | 9/1990 | Bang | 273/183 |
| 5,052,690 | 10/1991 | Sharp | 473/240 |
| 5,195,749 | 3/1993 | Ugarte | 273/187.4 |
| 5,275,403 | 1/1994 | Jones | 273/164.1 |
| 5,433,444 | 7/1995 | Chiuminatta et al. | 273/164.1 |

*Primary Examiner*—George J. Marlo
*Attorney, Agent, or Firm*—Gene Scott-Patent Law & Venture Group

[57] ABSTRACT

A golf putter provides an optical means for aiming the putter face including a rotatable mirror mounted on the top of the putter so as to image an indicia line on the mirror surface as well as an indicia line on the top of the putter. When these two lines are aligned colinearly in the mirror and the lines are pointed at the golf ball and the target, the face of the putter is perfectly aligned for driving the ball toward the target. The mirror is held in a frame that provides a detent means for locking the mirror in one of several selected positions repeatably, including a position for aiming the putter and a position for storing the mirror on the top of the putter so as to be unnoticed.

5 Claims, 2 Drawing Sheets

GOLF PUTTING DEVICE

BACKGROUND OF THE INVENTION

1. Field of the Invention

This invention relates generally to golf putters, and more particularly to a golf putter providing an optical means for aiming the putter in hitting a golf bail toward an intended target that is visible to a golfer.

2. Description of Related Art

The following art defines the present state of this field:

Bang, U.S. Pat. No. 4,953,866 describes a golf putter comprising a putting shaft, a putting head having a front face and a rear face, an aperture extending through the putting head from the front face to the rear face thereof, a supporting plate containing a mirror mounted to the rear face of the putting head an extending at an angle from the rear face, the mirror being mounted to coincide with the aperture disposed in the putting head, whereby the golfer, from a putting position can view both the ball and the hole by looking at the surface of the mirror.

Chiuminatta et al., U.S. Pat. No. 5,433,444 describes a targeting putter having improved alignment and swing compensation means. The putter comprises a putter shaft and a putter head having a striking face, heel, and toe ends, and a reflective prism mounted thereon. Adjustment allow for compensation of deficiencies in the golfer's stroke that tend to twist the putter head, or put too much or too little force into the swing.

Thiel, U.S. D245,438 describes the ornamental design for a detachable sighting mirror for golf putters.

Ugarte, U.S. Pat. No. 5,195,749 describes a golf club with a head or putter for the specific function of putting, which includes a front face with a negative inclination; a middle section inclined approximately 45°, a section which acts as a mirror with a view to lining up the stroke; an inclined edge which comes from the top end of the inclined face, of the base or of a horizontal surface continuing from the inclined one, with the peculiarity of altering the angle of the said inclination.

Jones, U.S. Pat. No. 5,275,403 describes a golf club comprising a hollow shaft having a top end in the vicinity of which a golfer grips the golf club, a bottom end within the vicinity of which a club head is attached, and an opening in the vicinity of the top end of the hollow shaft. The opening allows the golfer to look into the hollow shaft. A reflecting assembly located within the hollow shaft includes a reflective surface for reflecting through the hollow shaft an image of a target area where a golfer desires to hit a golf ball, thereby allowing the golfer to view simultaneously the target area while looking at the golf club. The shaft include a first passage formed substantially opposite the reflecting surface. The first passage permits the image to impact on the reflecting surface and be reflected through the hollow shaft toward the top end of the shaft.

Liotta, U.S. Pat. No. 3,700,244 describes a putter for use to improve skill in putting a golf ball with a ball engaging head which presents a spherical face to engage the ball. This face has a reflecting mirror surface in which the user of the putter can see the image of a ball while he grasps the putter handle. Within the reflecting area, and positioned in the area of the reflecting surface visible to the user grasping the putter, there is an indicator mark contrasting with the mirror surface so as to be readily visible.

Scott, U.S. Pat. No. 3,727,919 describes a golf club attachment comprising a sighting apparatus including a mirror to reflect the image of the area ahead of the club head in an upward direction to the eyes of the golfer which enables the golfer to align the face of the club head with a golf ball and the flagstick used on the putting green of a golf course. The mirror is pivotable about a first axis normal to the ball striking surface of the club head and also about a second axis normal to the first axis. The attachment is detachably secured to the club head by a channel shaped connecting arm which may be slid along an L-shaped support bar mounted on the rear surface of the club head.

The above prior art teaches the use of optics in the aiming of a golf putter. However, the prior art does not teach that the top surface of a putter can be used to provide an improved aiming surface to achieve a significant improvement in aim element visibility and positioning. The prior art also does not teach the use of a mirror which may be rotated to an operational position for practice and also a stored position for official play. The present invention fulfills these needs and provides further related advantages as described in the following summary.

SUMMARY OF THE INVENTION

The present invention teaches certain benefits in construction and use which give rise to the objectives described below.

The present invention provides a golf putter with an aiming mirror positionable for viewing both the ball and target from the golfers position while holding the putter in readiness for striking the ball. A pair of aiming lines (indicia) are fixed in place on the mirror and the top surface of the putter. These lines are viewed by the golfer and are alignable, so that with the putter oriented so that the two lines are colinear and directed at the center of the ball and the target, the putter is then positioned correctly for directing the ball at the target. In this case the target may be a flag, a cup, or a target selected for adjustment of terrain slope and roughness.

A primary objective of the present invention is to provide a golf putter with a rotatable, or folding, mirror so that the mirror may be positioned first in a position for aiming the putter, and second in a stored (hidden) position wherein the mirror is not discernible to other players, especially in tournament play. This allows the putter to be used both in practice as well as in official play.

Another objective is to provide such a putter having a mirror positioning detent means so that the mirror may be set to an identical position each time it is used. Such a detent means preferably provides established selected repeatable movement of the mirror to at least one aiming position, and possibly multiple aiming positions, and also to at least one position for storing the mirror.

A further objective is to provide such a putter with a line indicia on the mirror surface and a second line indicia on a flat surface of the putter itself. This arrangement allows for a large aiming window where the lines are highly visible and the golfer is able to see the lines well enough to arrange them colinearly with little difficulty. The use of the top surface of the golf putter head and the mirror for the alignment of the lines distinguishes the present invention over the prior art.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE PREFERRED EMBODIMENT

Figure 1:
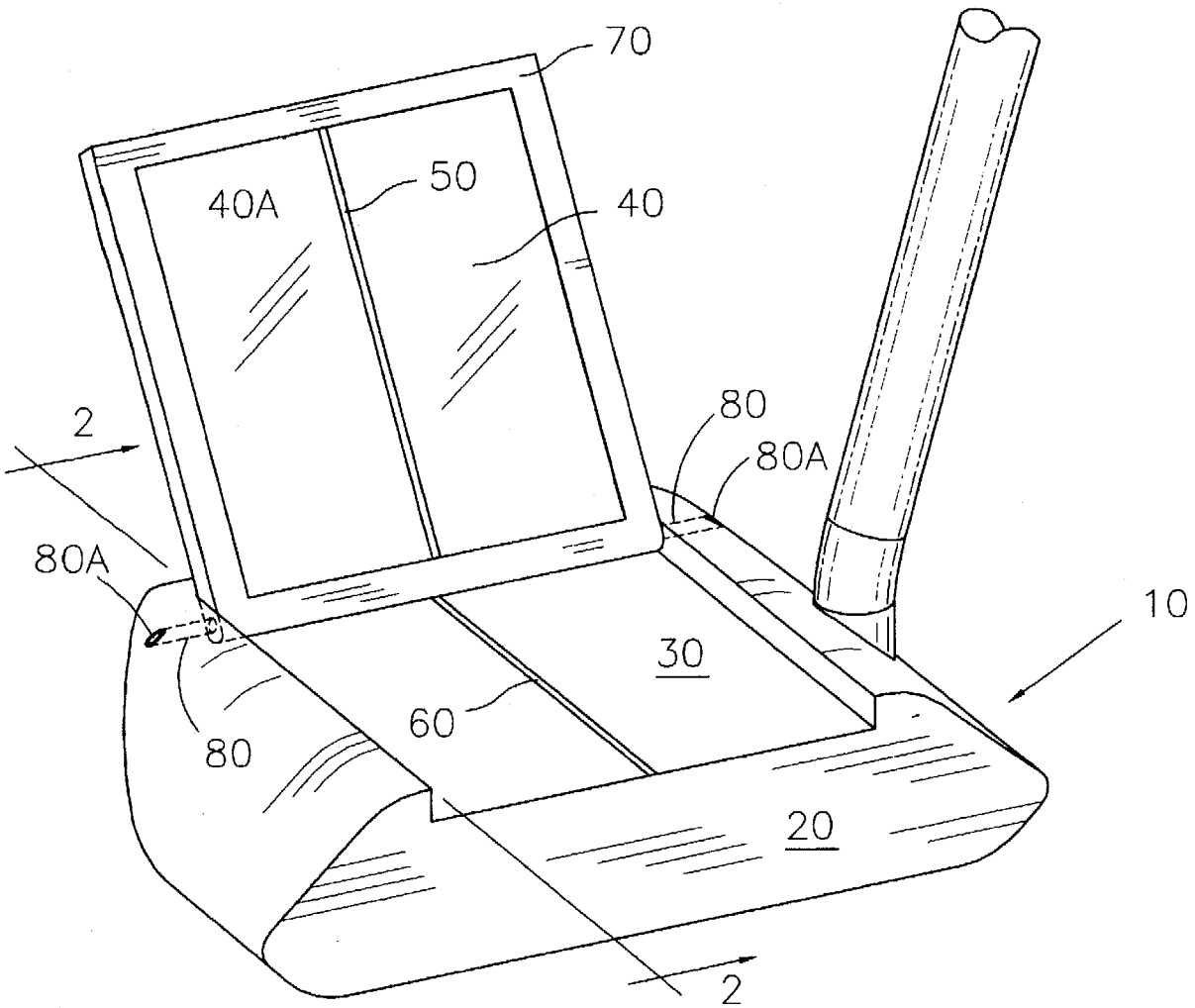
FIG. 1 is a perspective view of the preferred embodiment of the present invention.

The above described drawing figures illustrate the invention, a golf putting device, or putting club, or putter, for use in aiming a putt of a golf ball over a putting surface toward a target. The device comprises a putting head 10 providing a planar striking surface 20, the striking surface 20 being preferably oriented generally in the vertical when the putter is held in readiness for striking the golf ball (not shown). A planar top surface 30 is oriented generally in the horizontal when the putter is held in readiness for striking the golf ball. A planar mirror 40 is supported by, and preferably above, the top surface 30, the mirror 40 being tilted at an angle 100 so that the golf ball and the target (not shown) are both visible in the mirror 40 from above the putter, i.e., by a golfer (not shown) who is holding the putter in readiness for striking the ball. A first linear indicia 50 is positioned on the surface 40A of the mirror 40. Indicia 50 may be a painted or screened stripe, or may be a line of tape laid over the mirror surface 40A. Indicia 50 is preferably positioned as shown in FIG. 1. A second linear indicia 60 is positioned on the top surface 30 of the putter head 10. The second indicia 60 is of a similar nature to indicia 50, and is positioned preferably as shown in FIG. 1. The first and second linear indicia 50, 60 are positioned so that they are visually seen as being colinear in the mirror 40, and are alignable with the golf ball and further with the target, typically a flag pole or a cup, when the device is correctly positioned for striking the golf ball directly toward the target.

Preferably, the mirror 40 is held within a structural supporting frame 70 that is rotationally engaged with the putting head 10 by a horizontal axle 80 such that the mirror 40 may be rotated relative to the putting head over an angular range of at least 135 degrees. The axle 80 is rotationally engaged within supporting holes 80A in the head 10 on either side of the frame 70.

Figures 2, 3:
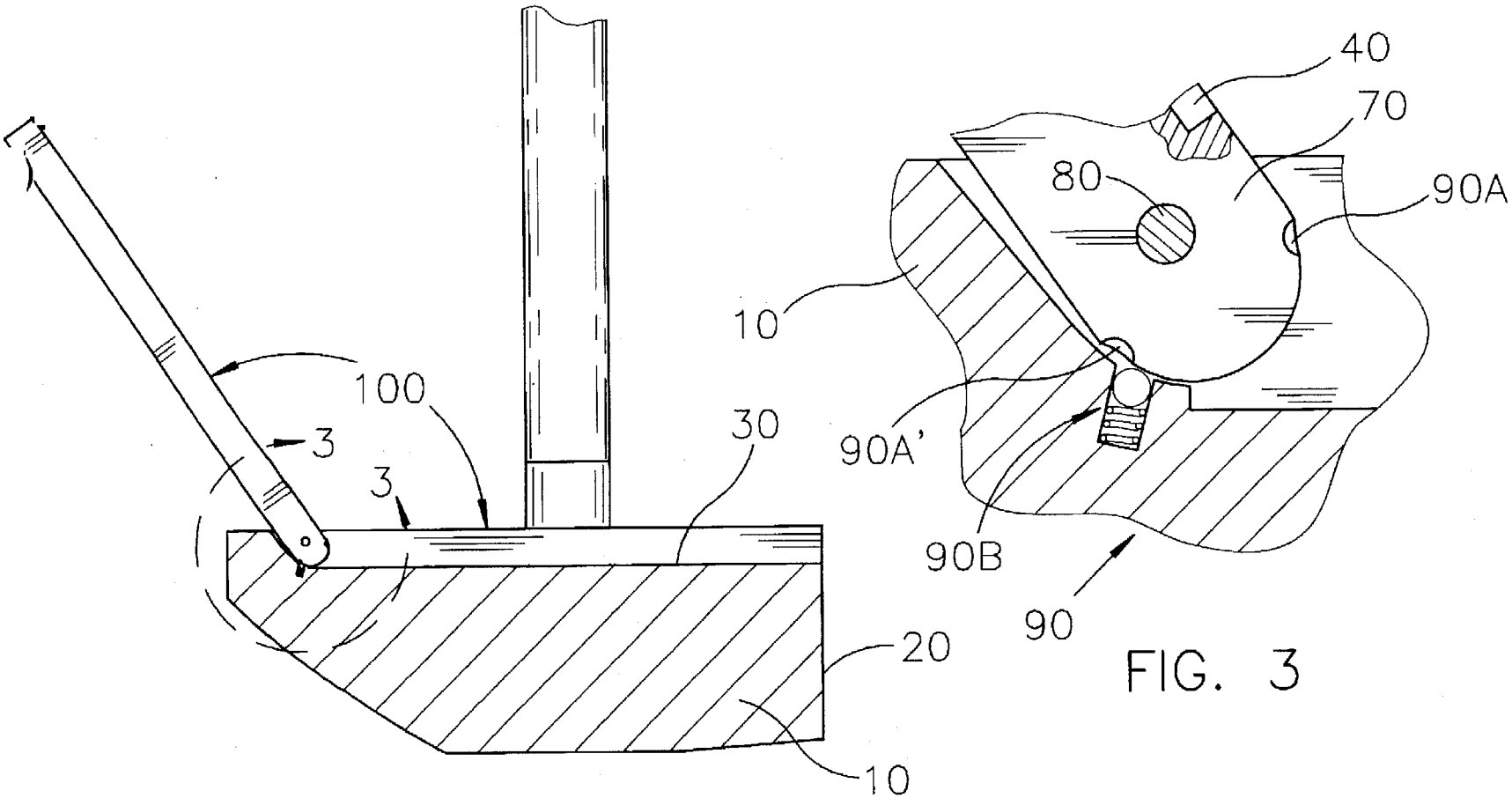
FIG. 2 is a side elevational cross-sectional view thereof taken along line 2—2 in FIG. 1.
FIG. 3 is an enlarged view of a portion of FIG. 2 taken along line 3–3.

A detent means 90, as best seen in FIG. 3, is provided for positioning the mirror at, at least one specific selected angle 100 relative to the top surface 30 of the putting head 10. The detent means 90 includes at least one concave depression 90A in the mirror supporting frame 70 and at least one corresponding, spring loaded ball bearing 90B positioned in the putting head 10 for cooperating with the at least one concave depression 90A in establishing the at least one angle 100 for the mirror 40. The mirror frame 70 is preferably rotatable to a horizontal position (not shown), wherein the mirror 40 is adjacent, and parallel to, the top surface 30 of the putting head 10. In FIG. 3 depression 90A is for positioning the mirror 40 in a horizontal, closed position; while for positioning the mirror 40 in a working upright position depression 90A' is provided. Other depressions might be used to allow positioning the mirror at a variety or a continuous sequence of positions. In an alternate embodiment, the putter might include a slot in the top of the putter head for insertion of the mirror in a fixed position for imaging the target and aligning the putter for an accurate putt. In this embodiment, the mirror would be removable for tournament play.

As indicated the device is used to more accurately aim a putter in the game of golf. The golfer views the ball and target through the minor and is therefore able to see both the indicia lines 50 and 60 as well as the golf ball and the target, at the same time. By rotating and otherwise positioning the golf club head 10 the golfer is able to align the two indicia lines 50 and 60 so that they appear colinear, i.e., one being a linear extension of the other. At the same time, the golfer positions the head 10 so that the indicia 60 is directed through the center of the golf ball, and is also directed at the center of the target. With the foregoing alignments, the face 20 of the golf club is perfectly positioned to strike the ball directly at the target.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A golf putting device for use in aiming a putt of a golf ball over a putting surface toward a target, the device comprising:

a putting head providing a planar striking surface, the striking surface being oriented generally in the vertical when the device is held in readiness for striking the golf ball, and a planar top surface, the top surface being oriented generally in the horizontal when the device is held in readiness for striking the golf ball;

a planar mirror rotatably supported on the planar top surface and rotatable to an angle so that the golf ball and the target are visible in the mirror from above the device and further rotatable to a horizontal position, wherein a mirror surface of the mirror lies in contact with the top surface of the putting head;

a first linear indicia on the mirror surface of the mirror;

a second linear indicia on the top surface;

the first and second linear indicia being positioned so that with the mirror rotated to the angle for viewing the target, the first and second linear indicia are colinearly aligned in the mirror and are alignable with the golf ball and, further, with the target when the device is correctly aimed for striking the golf ball toward the target.

2. The device of claim 1 wherein the mirror is held within a structural supporting frame, the frame being rotationally engaged with the putting head by a horizontal axle such that the mirror may be rotated relative to the putting head over an angular range of at least 135 degrees.

3. The device of claim 2 further including detent means for positioning the mirror at a, at least one, selected angle relative to the top surface of the putting head.

4. The device of claim 3 wherein the detent means includes at least one concave depression in the frame and at least one corresponding, spring loaded ball bearing positioned in the putting head for cooperating with the at least one concave depression in establishing the at least one angle for the mirror.

5. The device of claim 3 wherein the detent means includes at least one concave depression in the frame and at least one corresponding, spring loaded ball bearing positioned in the putting head for cooperating with the at least one concave depression in establishing the horizontal position for the mirror.

* * * * *